United States Patent [19]

Csincsa

[11] Patent Number: 5,015,907

[45] Date of Patent: May 14, 1991

[54] MULTI-FILAMENT FLUORESCENT LAMP CONSTRUCTION

[76] Inventor: Tibor Csincsa, 6479 Tisler Cres., Mississauga, Ontario, Canada, L5N 3G6

[21] Appl. No.: 434,214

[22] Filed: Nov. 13, 1989

[51] Int. Cl.[5] ..... H01J 1/00; H01J 61/067

[52] U.S. Cl. ..... 313/3; 313/236; 313/237

[58] Field of Search ..... 313/3, 236, 237, 149, 313/491

[56] References Cited

U.S. PATENT DOCUMENTS

| | | | |
|---|---|---|---|
| 2,659,836 | 11/1953 | Germer | 313/236 |
| 2,709,767 | 5/1955 | Germer | 313/236 |
| 3,504,218 | 3/1970 | Enidy et al. | 313/212 |
| 3,919,579 | 11/1975 | Lemmers | 313/273 |
| 4,454,447 | 6/1984 | Roche et al. | 313/492 |
| 4,745,333 | 5/1988 | Takagi et al. | 61/67 |

*Primary Examiner*—Sandra L. O'Shea

*Attorney, Agent, or Firm*—Henderson & Sturm

[57] ABSTRACT

A multi-filament fluorescent lamp construction (10) having a plurality of filament members (40) disposed on opposite ends of the lamp (10) wherein each of the filaments (40) is provided with a filament stud element (42) and a rotary switch unit (15) operatively associated with a rotary contact unit (13) to bring a contact spring element (32) into sequential electrical contact with the filament stud elements (42) so as to switch the flow of electricity from a dead filament member (40) to a live filament member (40).

2 Claims, 1 Drawing Sheet

MULTI-FILAMENT FLUORESCENT LAMP CONSTRUCTION

TECHNICAL FIELD

The present invention relates to fluorescent lamps in general, and in particular to a switchable multi-filament fluorescent lamp.

BACKGROUND ART

This invention was the subject matter of DDP Registration No. 220242 which was filed in the U.S. Patent and Trademark Office on Feb. 17, 1989.

As can be seen by reference to the following U.S. Pat. Nos.: 3,504,218; 3,919,579; 4,454,447; and 4,745,333, the prior art is replete with myriad and diverse multi-filament fluorescent lamps.

While the prior art constructions are more than adequate for the basic purpose and function for which they were specially designed, they do not address the problem of switching to a new filament when another filament has burned out in the fluorescent lamp.

In addition, most of the prior art constructions do not efficiently use the most expensive parts of a fluorescent lamp, such as the casing of the lamp and the fluorescent gas. As a consequence, once the filaments in the prior art devices have burned out, the fluorescent lamp has to be thrown out even though the only faulty part is the dead filament.

Therefore, there has existed a longstanding need among users of fluorescent lamps for a new type of multi-filament lamps that would allow the user to switch to a new filament when another filament has burned out.

In addition, this new device should be easy and safe to operate in the filament switching mode due to the lethal voltage employed in fluorescent lamps. This device should also be inexpensive to manufacture so that the deployment of such a device in fluorescent lamps is much less expensive than buying a new bulb.

Based on the foregoing situations, it is obvious that there has been a longstanding need for a fluorescent lamp design which would allow for an extended useful life for both the gas and the tube of a fluorescent lamp, and the provision of such a device is the stated object of the present invention.

DISCLOSURE OF THE INVENTION

The switchable multi-filament fluorescent lamp construction that forms the basis of the present invention comprises in general, a fluorescent tube engaging unit, an electrical contact unit, a rotation contact unit, a filament stud unit, a filament unit, and a rotary switch unit.

Briefly stated, the fluorescent tube engaging unit comprises a cylindrical cap member operably attached to the end of a fluorescent tube. The lamp engaging unit is further provided with a pair of apertures dimensioned to accommodate the electrical contact unit, wherein the electrical contact unit comprises a pair of extended rod elements each out-fitted with a cylindrical insulating sleeve and, wherein the rod elements serve as the external electrical connections and the insulating sleeves serve to electrically isolate the rod elements from the moving parts of the rotating switch.

The rotating contact unit of this invention comprises a filament engaging member associated with a sliding guide member, wherein the sliding guide member is connected to a pivot which anchors the guide member, thereby allowing the guide member to rotate around the pivot. The filament engaging member is further dimensioned to captively engage a stud member of the filament stud unit in a releasable manner, wherein when the rotating contact unit is moved, the engaging member disengages from the original filament stud member and engages with a neighboring stud member.

The filament unit comprises a plurality of conventional electrical filament elements. One end of each filament element is further associated with a separate filament stud member, wherein each stud member is sequentially engagable with the rotating contact unit and each filament. The other end of each filament element is connected to the first of the two rod elements which make up the electrical contact unit. In this way, a single filament is activated as contact is made with each filament stud member.

The rotary switch unit comprises a rotary collar member operatively connected to the rotating contact unit to move the filament engaging member in a sequential fashion relative to the filament stud members once one of the filaments has ceased to function.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
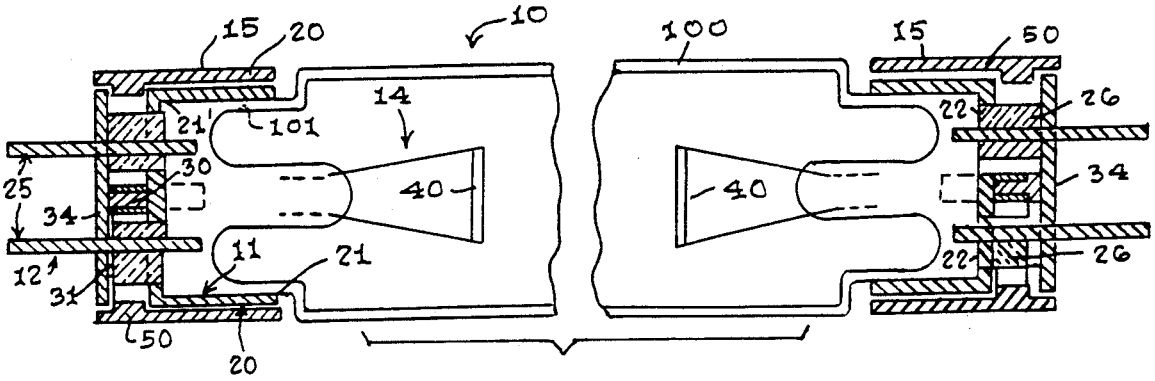
FIG. 1 is a cross-sectional view of the switchable multi-filament fluorescent lamp.
Figure 2:
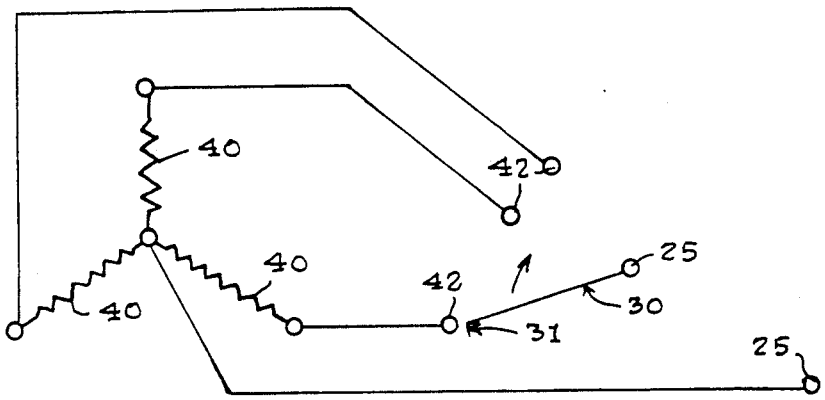
FIG. 2 is a schematic circuit diagram of the filament arrangement.
Figure 3:
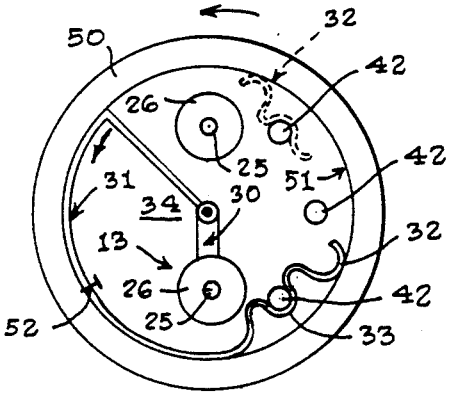
FIG. 3 is a cross-sectional detail view of the sliding contact plate as seen through line 3—3 of FIG. 1.

Referring now to the drawings, wherein like reference numerals designate identical or corresponding parts throughout the several views, FIGS. 1 and 3 depict the switchable multi-filament fluorescent lamp construction of the present invention designated generally by the reference numeral (10). The fluorescent lamp construction (10) comprises in general, a fluorescent tube engaging unit (11), an electrical contact unit (12), a rotating contact unit (13), a filament unit (14) and a rotary switch unit (15). These units will now be described in seriatim fashion.

As can be seen by reference to FIG. 1, the fluorescent tube engaging unit (11) comprises a cylindrical cap member (20) which is open at one end (21) and closed at the opposite end (21') wherein, the closed end (21') is provided with a pair of apertures (22). The open end (21) of the cap member (20) is further dimensioned to conform to the diameter of the end (101) of a fluorescent tube (100) wherein, the cap member (20) is operatively engaged in a permanent fashion to the end (10) of a fluorescent tube (100) in a well recognized manner.

Still referring to FIG. 1, it can be appreciated that the electrical contact unit (12) comprises in general, a pair of contact rod members (25) and a cooperating pair of insulating sleeve members (26), wherein the sleeve members (26) are dimensioned to receive rod members (25). The contact rod members (25) are formed of a material having high electrical conductivity, while the sleeve members (26) are formed from electrically insulated material. The sleeve members (26) are further dimensioned to be inserted and affixed in the apertures (22) of the cap member (20) of the tube engaging unit (11) wherein, the sleeve members (26) will rigidly hold the rod members (25) so that they project outwardly from the exterior of the tube (100), through the cap member (20) and into the inner tube space so as to conduct electricity in a well recognized manner through the fluorescent tube (100).

As shown in FIGS. 1 and 3, the rotating contact unit (13) comprises a contact rod engaging member (30) and a sliding contact member (31), wherein, the sliding contact member (31) is electrically and pivotally connected to an electrically conductive contact rod member (25), and the filament engaging member (33) is disposed on the free end of the sliding contact member (31).

In addition, an electrically insulated end plate (34) having suitably dimensioned apertures to accommodate the contact rod members (25) is placed in an abutting relationship against the outboard ends of the insulating sleeve members (26) to retain the rotating contact unit (13) in place.

As can best be seen by reference to FIG. 3, the sliding contact member (31) comprises an elongated contact spring element (32) having a generally arcuate outboard portion whose free end is configured in a generally sinusoidal pattern to form a releasable spring detent (33) whose purpose and function will be explained presently.

Figure 4:
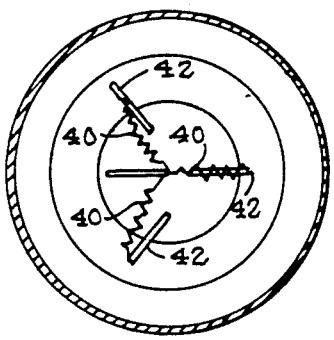
FIG. 4 is a cross-sectional view of the multiple filament array as seen through line 4—4 of FIG. 1.

Turning now to FIGS. 1, 3 and 4, it can be appreciated that the filament unit (14) comprises a plurality of conventional fluorescent filament members (40) arrayed on each end of the fluorescent lamp (100) wherein, each of the filament members (40) is provided with a filament stud element (42) on one end. In addition, as can be seen particularly by reference to FIGS. 1 and 3, the filament stud elements extend through the closed end (21') of the cylindrical cap member (20) at spaced locations and, each of the filament stud elements (42) are dimensioned to be engaged in a sequential fashion by the spring detent (33) on the rotating contact unit (13).

As shown in FIGS. 1 and 3, the rotary switch unit (15) comprises rotary collar members (50) disposed on opposite ends of the fluorescent lamp (100) intermediate the electrically insulated end plates (34) of the rotary contact unit (13) and the open end (21) of the fluorescent tube engaging unit (11), wherein, a portion of the internal wall (51) of the rotary collar member (50) is operatively attached as at (52) to the contact spring element (32) such that the rotary movement of the rotary collar member (50) will be imparted to the contact spring element (32) to sequentially engage the contact spring detent (33) with the spaced filament stud element.

By now it should be appreciated that once one of the filament members (40) of this construction ceases to function all that is necessary to restore the fluorescent lamp (100) to its operative mode is for the user to rotate the proper rotary collar member (50) to bring the contact spring detent (33) into engagement with the next filament stud element (42) operatively connected to a functioning filament member (40).

Having thereby described the subject matter of this invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A multi-filament fluorescent lamp construction comprising:

a fluorescent tube having a cylindrical cap member formed on opposite ends;

an electrical contact unit associated with each of the cap members and including a pair of electrical contact rod members each being surrounded by an insulating sleeve member; wherein, the ends of the electrical contact rod members extend into said fluorescent tube;

a filament unit comprising a plurality of filament members disposed on opposite ends of said fluorescent tubes wherein each of said plurality of filament members is provided with a filament stud element;

a rotating contact unit disposed on opposite ends of the fluorescent lamp and comprising a contact rod engaging member and a sliding contact member adapted to sequentially engage the filament stud elements on said plurality of filament members disposed on the respective ends of the fluorescent lamp; wherein the sliding contact member comprises a contact spring element which is provided with a sinusoidally contoured spring detent portion which is dimensioned to sequentially and releasably engage said plurality of filament stud elements; and, means for bringing said sliding contact member into said sequential engagement with said filament stud elements.

2. The construction as in claim 1 wherein said means for bringing said sliding contact member into said sequential engagement with said filament stud elements comprises a rotary switch unit.

* * * * *